US011561502B2

(12) United States Patent
Ooka et al.

(10) Patent No.: US 11,561,502 B2
(45) Date of Patent: Jan. 24, 2023

(54) IMAGE FORMING APPARATUS INCLUDING SUPPORT FRAME WITH GROUND PLATE AND CONTACT SPRING

(71) Applicant: BROTHER KOGYO KABUSHIKI KAISHA, Nagoya (JP)

(72) Inventors: Kazuaki Ooka, Nagoya (JP); Hikaru Iino, Niwa-gun (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/398,108

(22) Filed: Aug. 10, 2021

(65) Prior Publication Data

US 2022/0206428 A1 Jun. 30, 2022

(30) Foreign Application Priority Data

Dec. 28, 2020 (JP) ..... JP2020-219205

(51) Int. Cl.
*G03G 21/16* (2006.01)
*G03G 21/18* (2006.01)

(52) U.S. Cl.
CPC ..... *G03G 21/1647* (2013.01); *G03G 21/1652* (2013.01); *G03G 21/1821* (2013.01); *G03G 21/1867* (2013.01); *G03G 2221/1654* (2013.01); *G03G 2221/1869* (2013.01)

(58) Field of Classification Search
CPC ..... G03G 21/1647; G03G 21/1652; G03G 21/1821; G03G 21/1867; G03G 2221/1654; G03G 2221/166; G03G 2221/1869
See application file for complete search history.

(56) References Cited

U.S. PATENT DOCUMENTS 9,946,186 B2 * 4/2018 Miyamoto ..... G03G 21/1652
2014/0093279 A1 * 4/2014 Hayakawa ..... G03G 21/1821 399/117

FOREIGN PATENT DOCUMENTS

JP 2014-66840 A 4/2014

* cited by examiner

*Primary Examiner* — Sophia S Chen
(74) *Attorney, Agent, or Firm* — Merchant & Gould P.C.

(57) ABSTRACT

An image forming apparatus includes: a process cartridge; and an apparatus main body to which the process cartridge is attachable and from which the process cartridge is detachable. The process cartridge includes: a photoconductive drum, and an electrode connected to the photoconductive drum and having a contact surface facing downward. The apparatus main body includes: a support frame supporting one end portion of the process cartridge in an axis direction of the photoconductive drum, a ground metal plate supported by the support frame and connected to ground, and a spring supported by the support frame and configured to contact with the contact surface of the electrode from below to connect the electrode and the ground metal plate.

16 Claims, 18 Drawing Sheets

IMAGE FORMING APPARATUS INCLUDING SUPPORT FRAME WITH GROUND PLATE AND CONTACT SPRING

CROSS-REFERENCE TO RELATED APPLICATIONS

This application claims priority from Japanese Patent Application No. 2020-219205 filed on Dec. 28, 2020, the entire contents of which are incorporated herein by reference.

TECHNICAL FIELD

The present invention relates to an image forming apparatus.

BACKGROUND

An image forming apparatus in the related art includes apparatus main body, and a process cartridge having a photoconductive drum and attachable to and detachable from the apparatus main body. When the process cartridge is attached to the apparatus main body, the photoconductive drum and a grounding member provided in the apparatus main body are connected to each other, and the photoconductive drum is connected to ground.

For example, in an image forming apparatus of the related art, a metal plate connected to a photoconductive drum is attached to one end portion of a process cartridge in an axis direction of the photoconductive drum, and the photoconductive drum is connected to ground by bringing a ground electrode connected to the grounding member provided in an apparatus main body into contact with the metal plate from the axis direction.

However, in the image forming apparatus of the related art, since a coil spring applying an urging force in the axis direction is used as the ground electrode and the ground electrode is brought into contact with the metal plate from the axis direction, a large space for connecting the ground electrode and the metal plate in the axis direction is required.

SUMMARY

In the present disclosure, there is provided an image forming apparatus capable of reducing a space for connecting a photoconductive drum and a grounding member included in an apparatus main body in an axis direction to reduce a size of the apparatus main body.

Disclosed here is an image forming apparatus including a process cartridge and an apparatus main body to which the process cartridge is attachable and from which the process cartridge is detachable. The process cartridge includes a photoconductive drum, and an electrode connected to the photoconductive drum and having a contact surface facing downward. The apparatus main body includes a support frame supporting one end portion of the process cartridge in an axis direction of the photoconductive drum, a ground metal plate supported by the support frame and connected to ground, and a spring supported by the support frame and configured to contact with the contact surface of the electrode from below to connect the electrode and the ground metal plate.

DETAILED DESCRIPTION

Next, an embodiment of the present disclosure will be described with reference to the drawings.

Image Forming Apparatus

Figure 1:
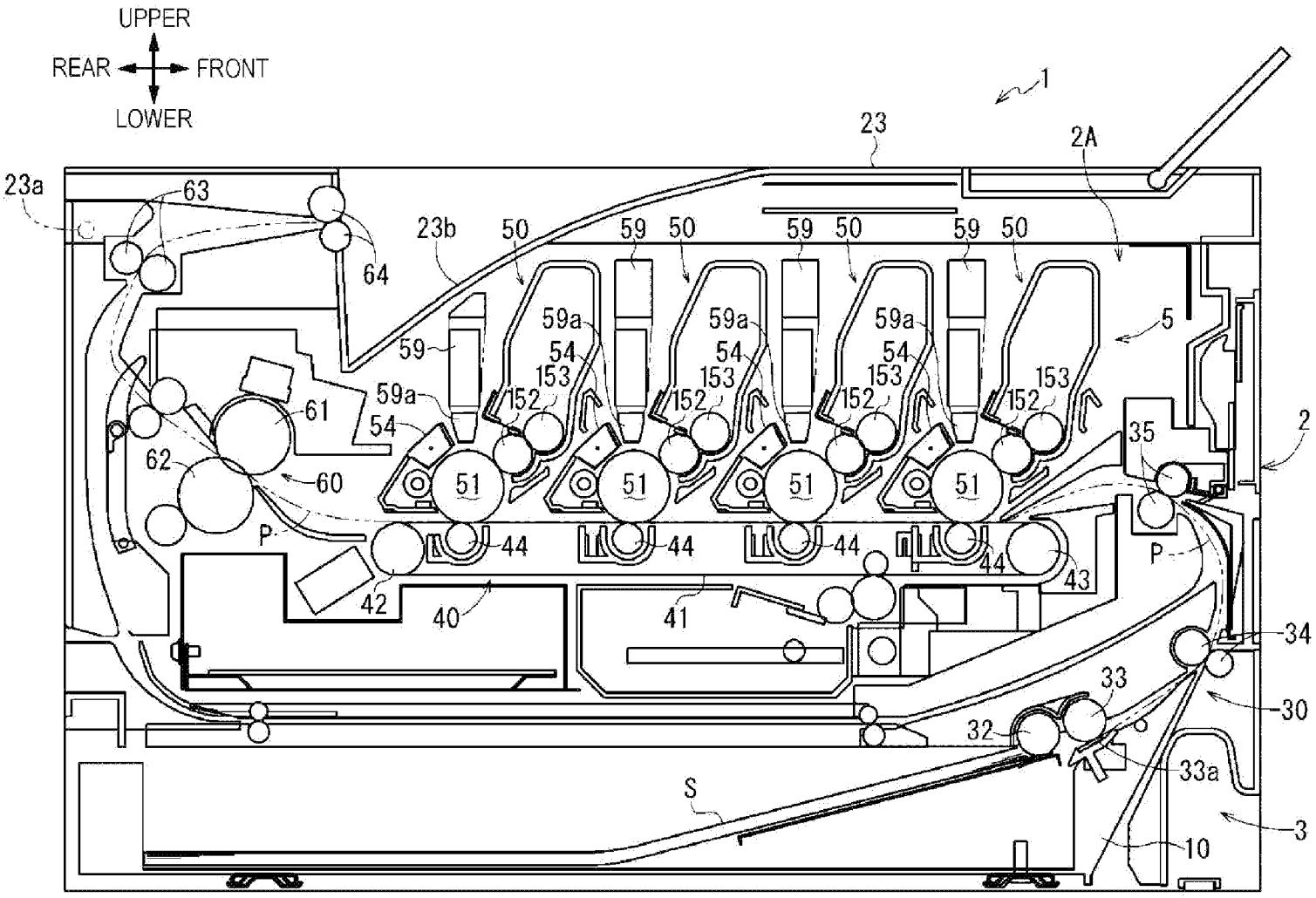
FIG. 1 is a central sectional view showing an image forming apparatus.

An image forming apparatus 1 shown in FIG. 1 is an embodiment of an image forming apparatus according to the present disclosure, and is a color laser printer that forms images of a plurality of colors on a sheet S by an electrophotographic method.

In the following description, a right side in FIG. 1 is defined as a front side of the image forming apparatus 1, a left side in FIG. 1 is defined as a rear side of the image forming apparatus 1, a front side of a drawing sheet in FIG. 1 is defined as a left side of the image forming apparatus 1, and a back side of the drawing sheet in FIG. 1 is defined as a right side of the image forming apparatus 1. In addition, an upper side and a lower side in FIG. 1 are defined as an upper side and a lower side of the image forming apparatus 1, respectively.

The image forming apparatus 1 includes an apparatus main body 2, a sheet feeding unit 3 including a sheet feeding tray 10 that supports the sheet S and a sheet transport unit 30 that transports the sheet S, and an image forming unit 5 that forms an image on the sheet S transported by the sheet feeding unit 3.

The apparatus main body 2 is formed in a substantially rectangular parallelepiped shape, and accommodates the sheet feeding unit 3 and the image forming unit 5. An opening portion 2A is opened in an upper surface of the apparatus main body 2, and the apparatus main body 2 includes a top cover 23 capable of opening and closing the opening portion 2A.

The top cover 23 is pivotable around a pivot shaft 23*a* at a rear end portion thereof, and is movable between a closed position at which the top cover 23 closes the opening portion 2A and an open position at which the opening portion 2A is opened by pivoting around the pivot shaft 23*a*. A sheet discharge tray 23*b*, which is inclined downward from the front side toward the rear side, is formed in the top cover 23 of the apparatus main body 2.

The sheet feeding unit 3 is disposed at a lower portion of the apparatus main body 2, and transports the sheet S supported by the sheet feeding tray 10 to the image forming unit 5 by the sheet transport unit 30. The sheet feeding tray 10 is slidable in a front-rear direction, and is movable between an accommodation position at which the sheet feeding tray 10 is accommodated in the apparatus main body 2 and a separation position at which the sheet feeding tray 10 is pulled out forward from the accommodation position.

The sheet transport unit 30 includes a sheet feeding roller 32, a separation roller 33, a separation pad 33*a*, a pair of transport rollers 34, and a pair of registration rollers 35. In the apparatus main body 2, a transport path P of the sheet S from the sheet feeding tray 10 to a sheet discharge tray 23*a* via the image forming unit 5 is formed.

The sheets S supported by the sheet feeding tray 10 are separated one by one by the sheet feeding roller 32, the separation roller 33, and the separation pad 33*a* and fed to the transport path P. The sheet feeding roller 32 is a roller that transports the sheet S from the sheet feeding tray 10 toward the image forming unit 5. The separation roller 33 and the separation pad 33*a* constitute separation means that separates the sheets S supported by the sheet feeding tray 10 one by one.

The sheet S fed to the transport path P is transported toward the image forming unit 5 by the pair of transport rollers 34 and the pair of registration rollers 35. The pair of registration rollers 35 temporarily stops by regulating a movement of a front end of the sheet S to be transported, and then transports the sheet S toward the image forming unit 5 at a predetermined timing.

The image forming unit 5 is disposed above the sheet feeding unit 3, and includes four process cartridges 50 arranged side by side in the front-rear direction. Each process cartridge 50 is provided corresponding to each color of black, yellow, magenta, and cyan. The process cartridge 50 is detachably attached to the apparatus main body 2. Each process cartridge 50 includes a photoconductive drum 51, a developing roller 152, a supply roller 153, and a charger 54.

The process cartridge 50 is attached to the apparatus main body 2 in a posture in which an axis X (see FIG. 3) of the photoconductive drum 51 extends in a left-right direction. The left-right direction is an example of an axis direction. The developing roller 152 is movable between an abutting position at which the developing roller 152 abuts against the photoconductive drum 51 and a separation position at which the developing roller 152 is separated from the photoconductive drum 51. The supply roller 153 supplies toner contained in the process cartridge 50 to the developing roller 152.

The apparatus main body 2 includes exposure heads 59 that each expose a surface of the photoconductive drum 51. The exposure head 59 is supported by the top cover 23. Four exposure heads 59 are provided corresponding to the respective photoconductive drums 51, and the exposure heads 59 are arranged side by side in the front-rear direction. The exposure head 59 extends downward from the top cover 23, and has an exposure unit 59*a* at a lower end portion thereof. The exposure unit 59*a* is disposed close to and above the photoconductive drum 51 in a state in which the top cover 23 is closed. The exposure unit 59*a* is configured by an LED array including a plurality of LED elements arranged in parallel in the left-right direction.

A transfer belt 41 is disposed so as to face the photoconductive drum 51 below the transport path P of the photoconductive drum 51. The transfer belt 41 is hung between a drive roller 42 and a driven roller 43 disposed in front of the drive roller 42. The transfer belt 41, the drive roller 42, and the driven roller 43 constitute a belt device 40. Transfer rollers 44 are disposed at positions facing the respective photoconductive drums 51 sandwiching the transfer belt 41.

In the image forming unit 5, the photoconductive drum 51 uniformly charged by the charger 54 is selectively exposed by the exposure head 59. By this exposure, electric charges are selectively removed from the surface of the photoconductive drum 51, and an electrostatic latent image is formed on the surface of the photoconductive drum 51.

The toner contained in the process cartridge 50 is positively charged between the supply roller 153 and the developing roller 152, and is carried on a surface of the developing roller 152. A developing bias is applied to the developing roller 152, and when the electrostatic latent image formed on the photoconductive drum 51 faces the developing roller 152, the toner is supplied from the developing roller 152 to the electrostatic latent image by a potential difference between the electrostatic latent image and the developing roller 152. Therefore, a toner image is formed on the surface of the photoconductive drum 51.

When the sheet S transported toward the image forming unit 5 reaches the transfer belt 41, the sheet S is transported by the transfer belt 41 and sequentially passes between the transfer belt 41 and each photoconductive drum 51. Further, when the toner image on the surface of the photoconductive drum 51 faces the sheet S, the toner image is transferred to the sheet S by a transfer bias applied to the transfer roller 44.

The transfer belt 41 in the present embodiment is configured as a transport belt that transports the sheet S to which the toner image is transferred, but the transfer belt 41 may be configured as an intermediate transfer belt in which the toner image is transferred to the belt itself and the toner image transferred to the belt is further transferred to the sheet S.

The sheet S to which the toner image is transferred is transported to a fixing device 60. The fixing device 60 includes a heating roller 61 and a pressure roller 62 that is pressed against the heating roller 61, and the toner image is heat-fixed while the sheet S transported to the fixing device 60 passes between the heating roller 61 and the pressure roller 62.

The sheet S on which the toner image is heat-fixed is transported from the fixing device 60 to a downstream side in a transport direction, is further transported by a pair of intermediate sheet discharge rollers 63 and a pair of sheet discharge rollers 64 disposed on the downstream side in the transport direction of the pair of intermediate sheet discharge rollers 63, and is discharged to the sheet discharge tray 23*b*.

Figure 2:
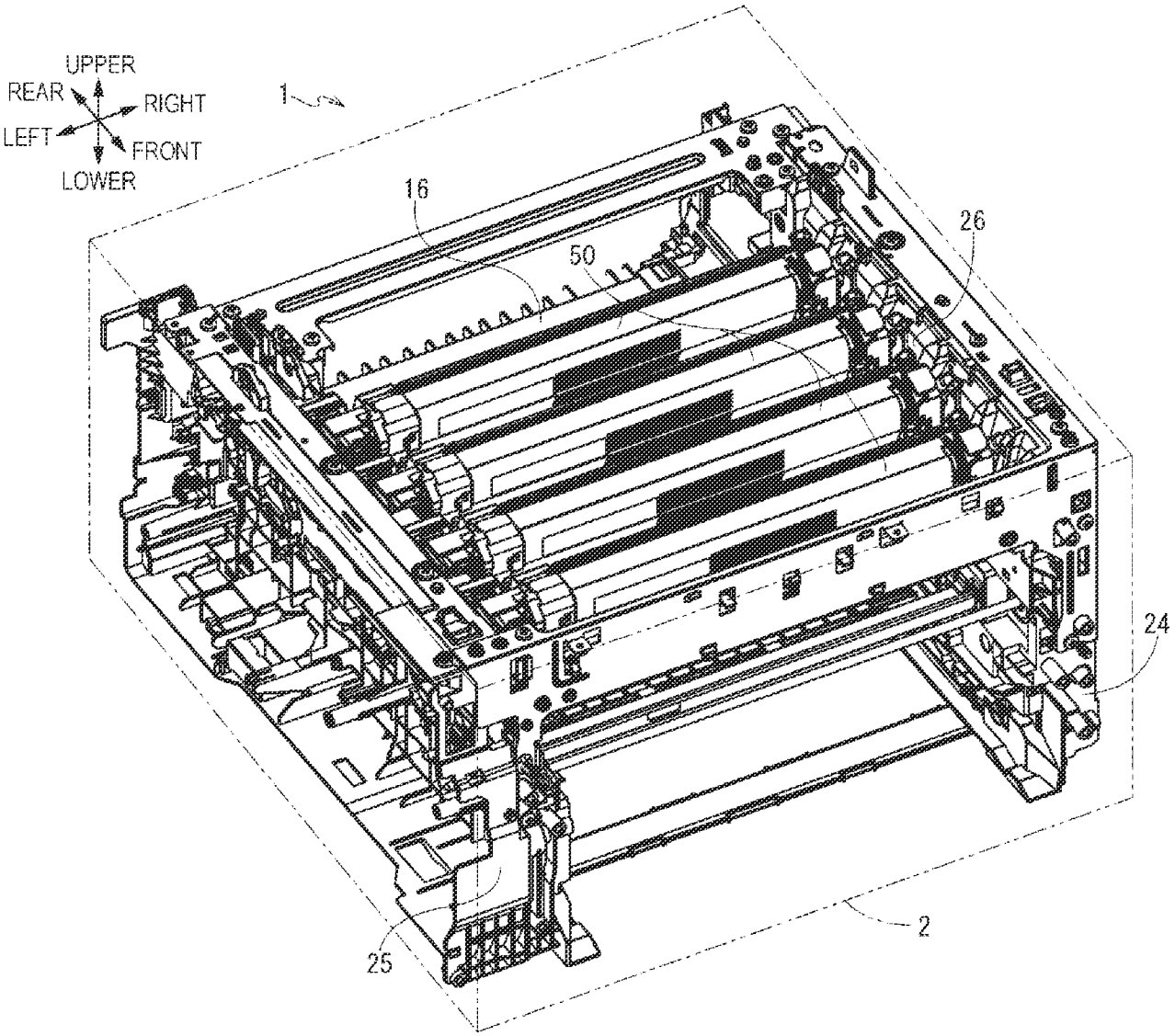
FIG. 2 is a perspective view showing an inner portion of an apparatus main body of the image forming apparatus.

As shown in FIG. 2, the apparatus main body 2 includes a first main body frame 24 and a second main body frame 25 that are arranged apart from each other in the left-right direction. The first main body frame 24 is located at a right end portion of the apparatus main body 2 and extends in the front-rear direction and an upper-lower direction. The second main body frame 25 is located at a left end portion of the apparatus main body 2 and extends in the front-rear direction and the upper-lower direction. A support frame 26 is attached to an inner surface of the first main body frame 24 in the left-right direction, which is a surface facing the second main body frame 25.

The process cartridge 50 is disposed between the support frame 26 and the second main body frame 25, and is attachably and detachably supported by the support frame 26 and the second main body frame 25. The support frame 26 is located on a right side of the process cartridge 50 and supports a right end portion 50A (see FIG. 3) of the process cartridge 50. The second main body frame 25 is located on a left side of the process cartridge 50, and supports a left end portion 50B (see FIG. 3) of the process cartridge 50. The right end portion 50A is an example of one end portion of the photoconductive drum in the axis direction, and the left end portion 50B is an example of another end portion of the photoconductive drum in the axis direction.

Process Cartridge

Figure 3:
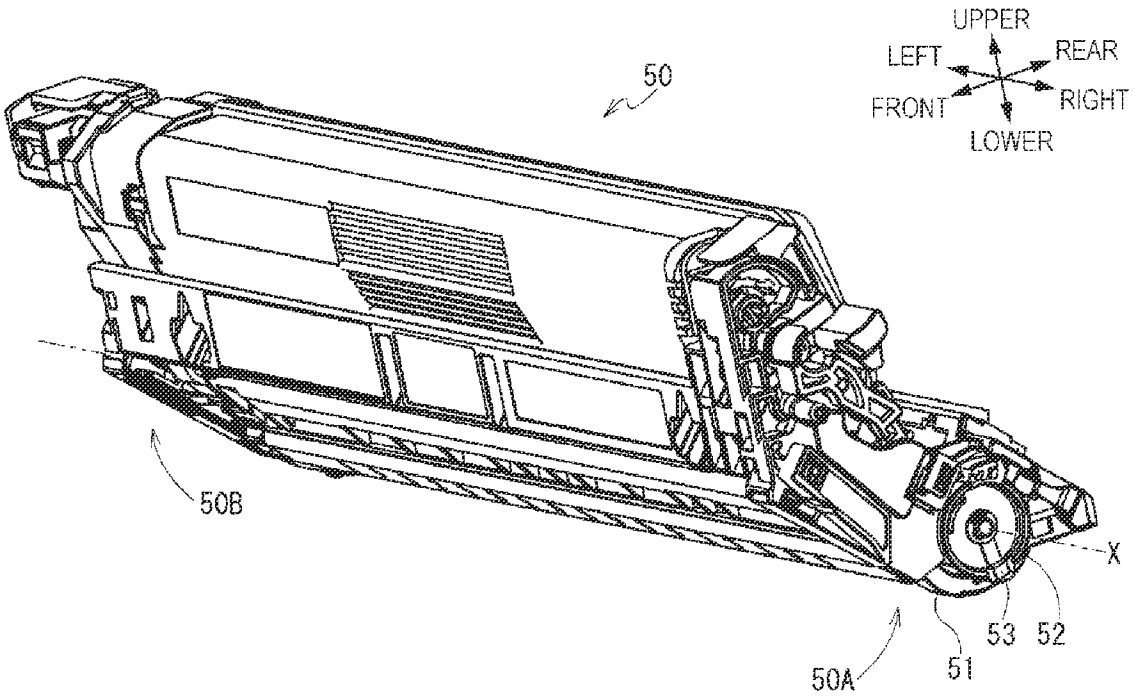
FIG. 3 is a perspective view showing a process cartridge.
Figure 4:
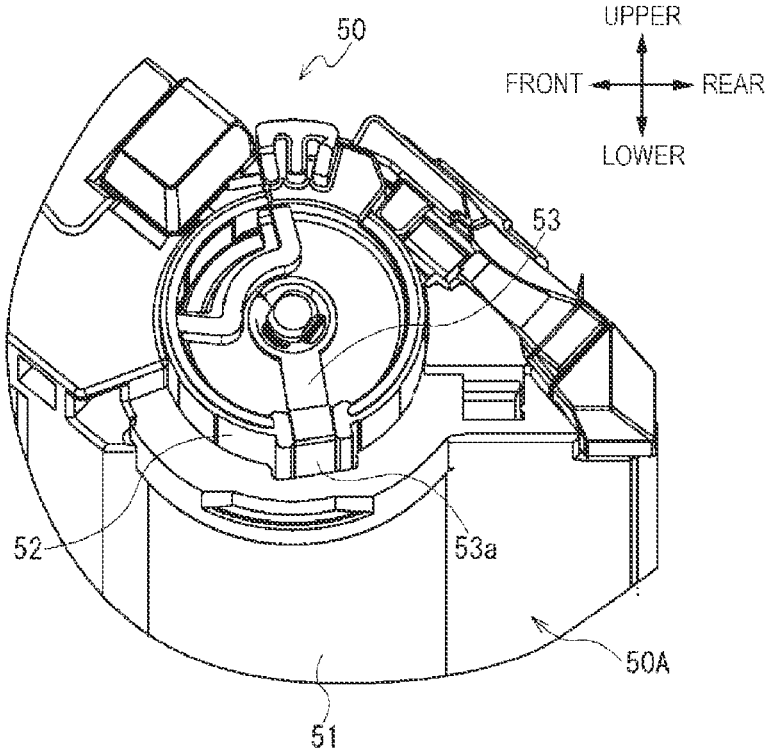
FIG. 4 is a perspective view showing a right end portion of the process cartridge.
Figure 5:
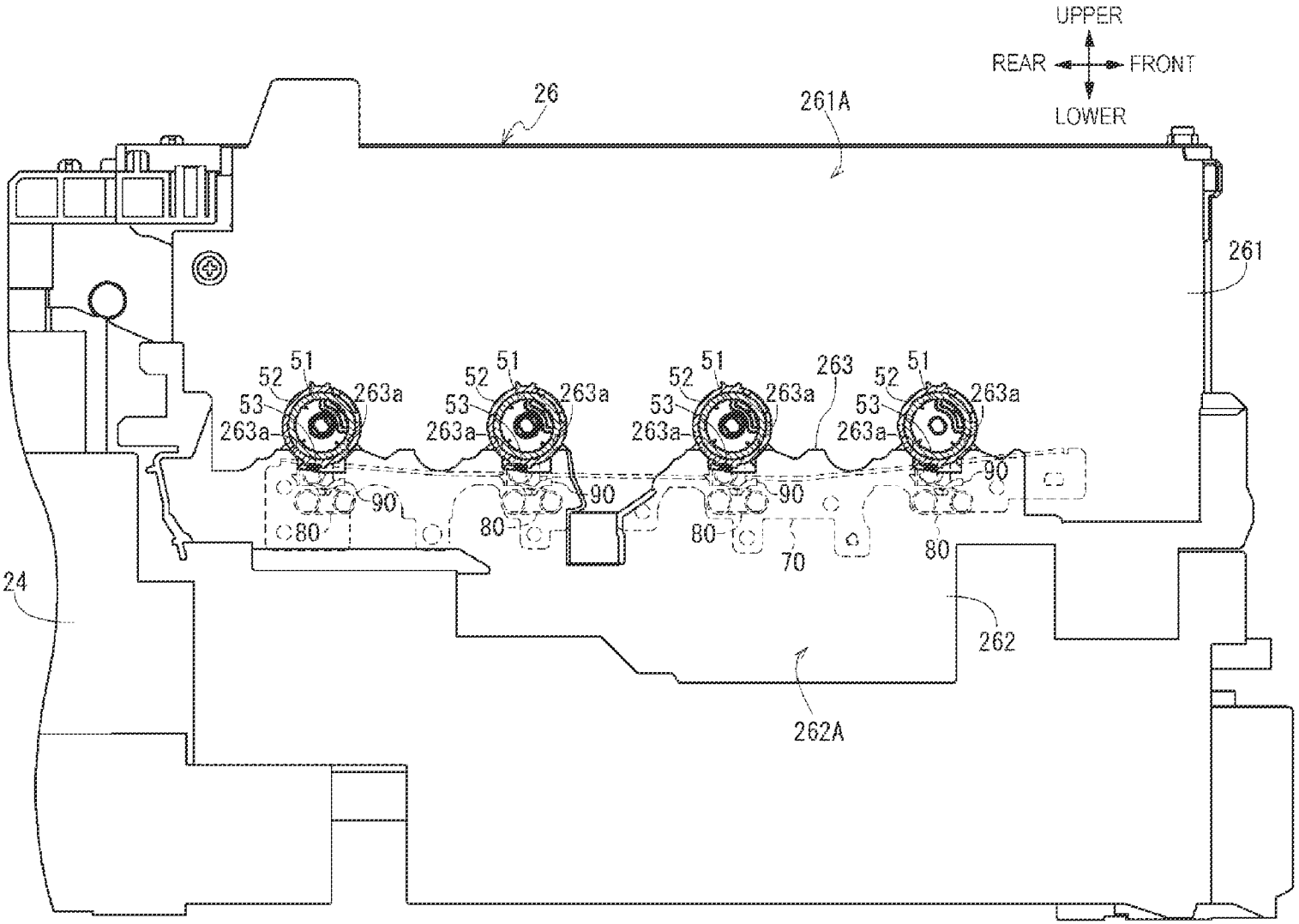
FIG. 5 is a side sectional view showing an inner side surface of a support frame.
Figure 6:
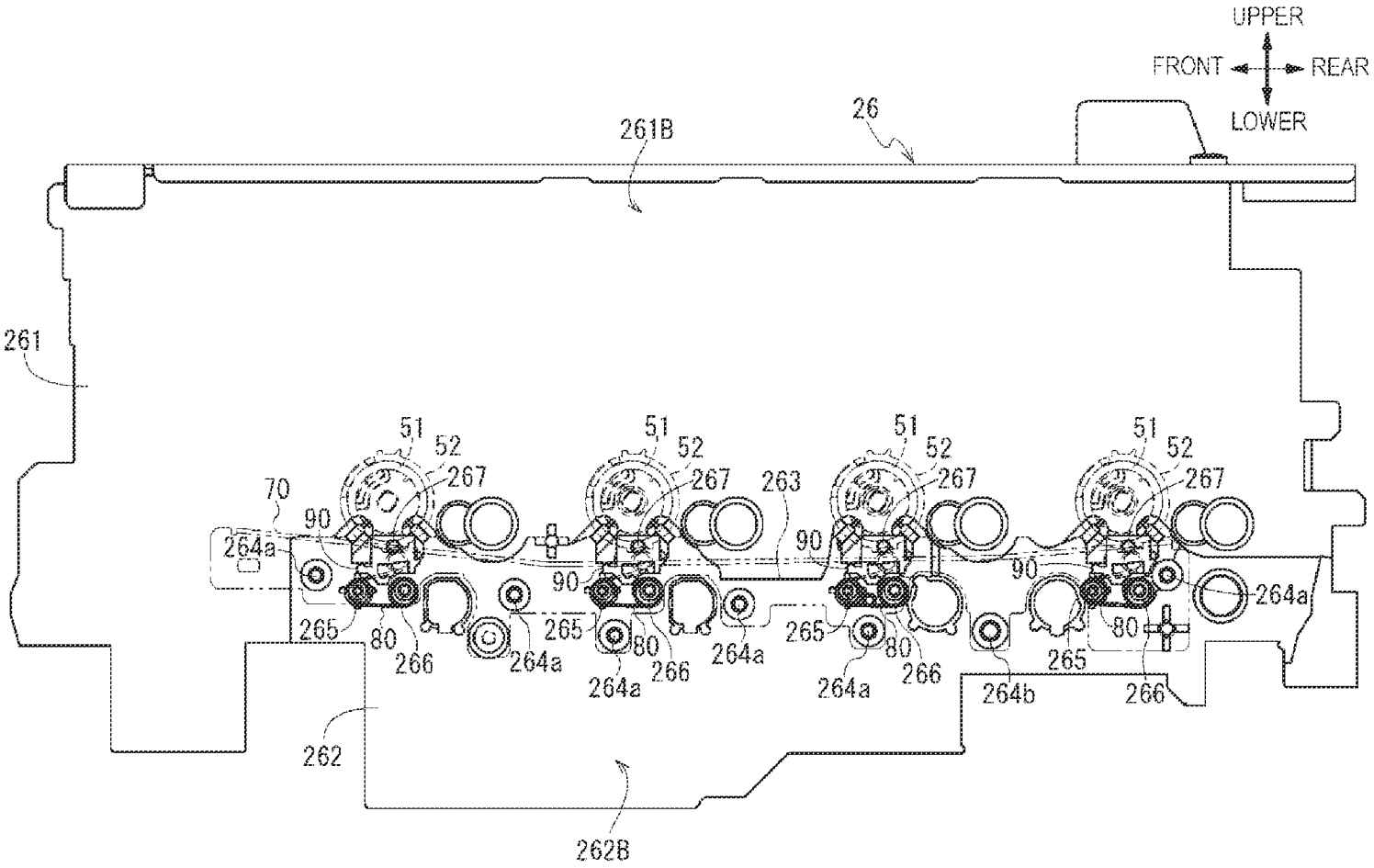
FIG. 6 is a side view showing an outer side surface of the support frame.
Figure 7:
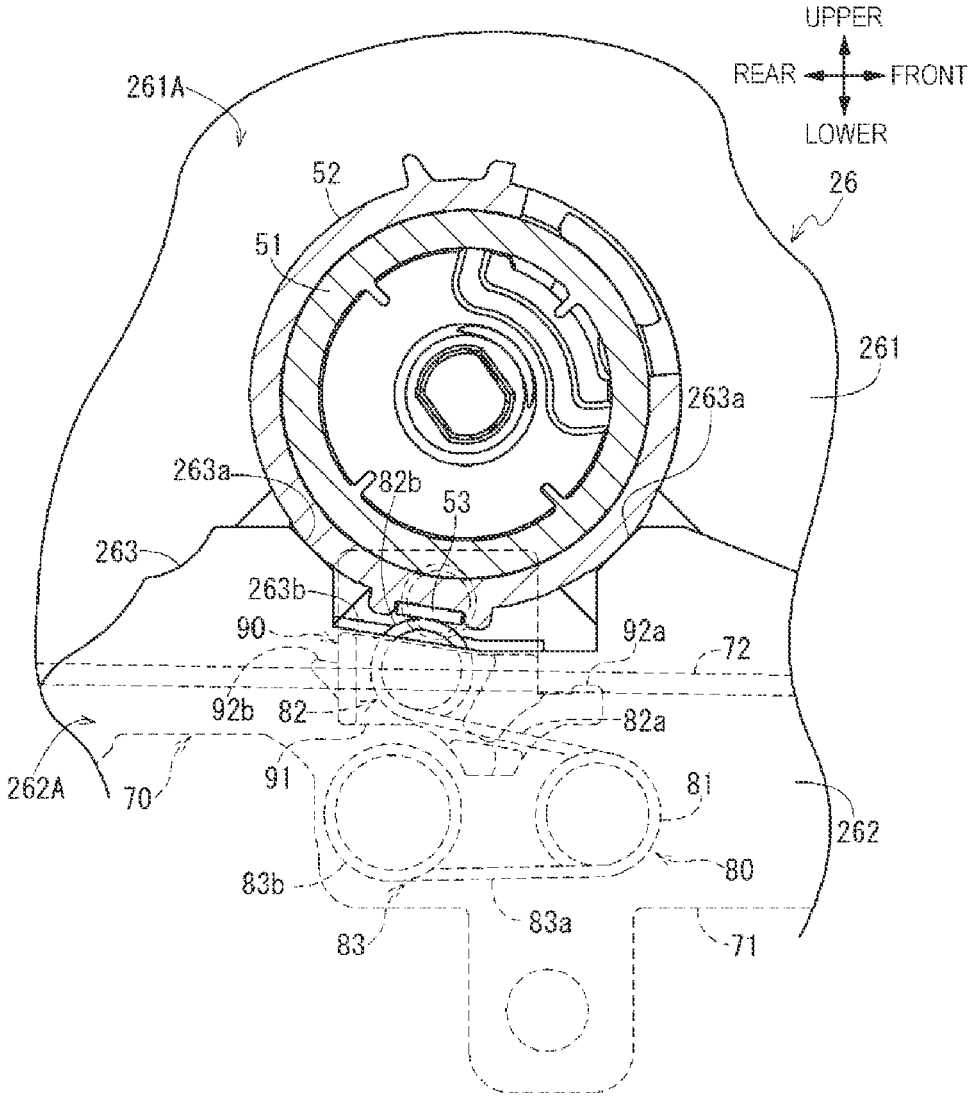
FIG. 7 is a side sectional view of a contact state between an electrode and a spring as viewed from the inner side surface side of the support frame.

As shown in FIGS. 3 and 4, each process cartridge 50 includes a bearing portion 52 supporting a right end portion that is the one end portion of the photoconductive drum 51 in the axis X direction, and an electrode 53 connected to the photoconductive drum 51. The electrode 53 is located at a lower end of an outer peripheral surface of the bearing portion 52, and has a contact surface 53*a* facing downward. The bearing portion 52 and the electrode 53 are located at the right end portion 50A of the process cartridge 50.

Support Frame

As shown in FIGS. 5 to 9, the support frame 26 includes a first wall portion 261, a second wall portion 262, and a step portion 263. The first wall portion 261 is located at an upper portion of the support frame 26, and the second wall portion 262 is located below the first wall portion 261. The second wall portion 262 is located inward in the left-right direction than the first wall portion 261. That is, in the axis X direction, the second wall portion 262 is located closer to the photoconductive drum 51 than the first wall portion 261.

The first wall portion 261 includes an inner side surface 261A facing the process cartridge 50 in the axis X direction, and an outer side surface 261B opposite to the inner side surface 261A, which faces the first main body frame 24 in the axis X direction. The second wall portion 262 includes an inner side surface 262A that is a surface on a process cartridge 50 side in the axis X direction, and an outer side surface 262B opposite to the inner side surface 262A, which faces the first main body frame 24 in the axis X direction.

The step portion 263 is formed between the first wall portion 261 and the second wall portion 262. The step portion 263 includes a positioning portion 263*a* that abuts against the bearing portion 52 of the photoconductive drum 51 to position the photoconductive drum 51 when the process cartridge 50 is attached to the apparatus main body 2. The support frame 26 supports one bearing portion 52 by a pair of positioning portions 263*a* arranged in the front-rear direction. The step portion 263 has a through hole 263*b* penetrating in the upper-lower direction between the pair of positioning portions 263*a* that support the bearing portion 52.

In the step portion 263, the pair of positioning portions 263*a* and the through holes 263*b* are formed at four positions along the front-rear direction corresponding to the number of process cartridges 50 supported by the support frame 26.

Configuration for Grounding Photoconductive Drum

Figure 8:
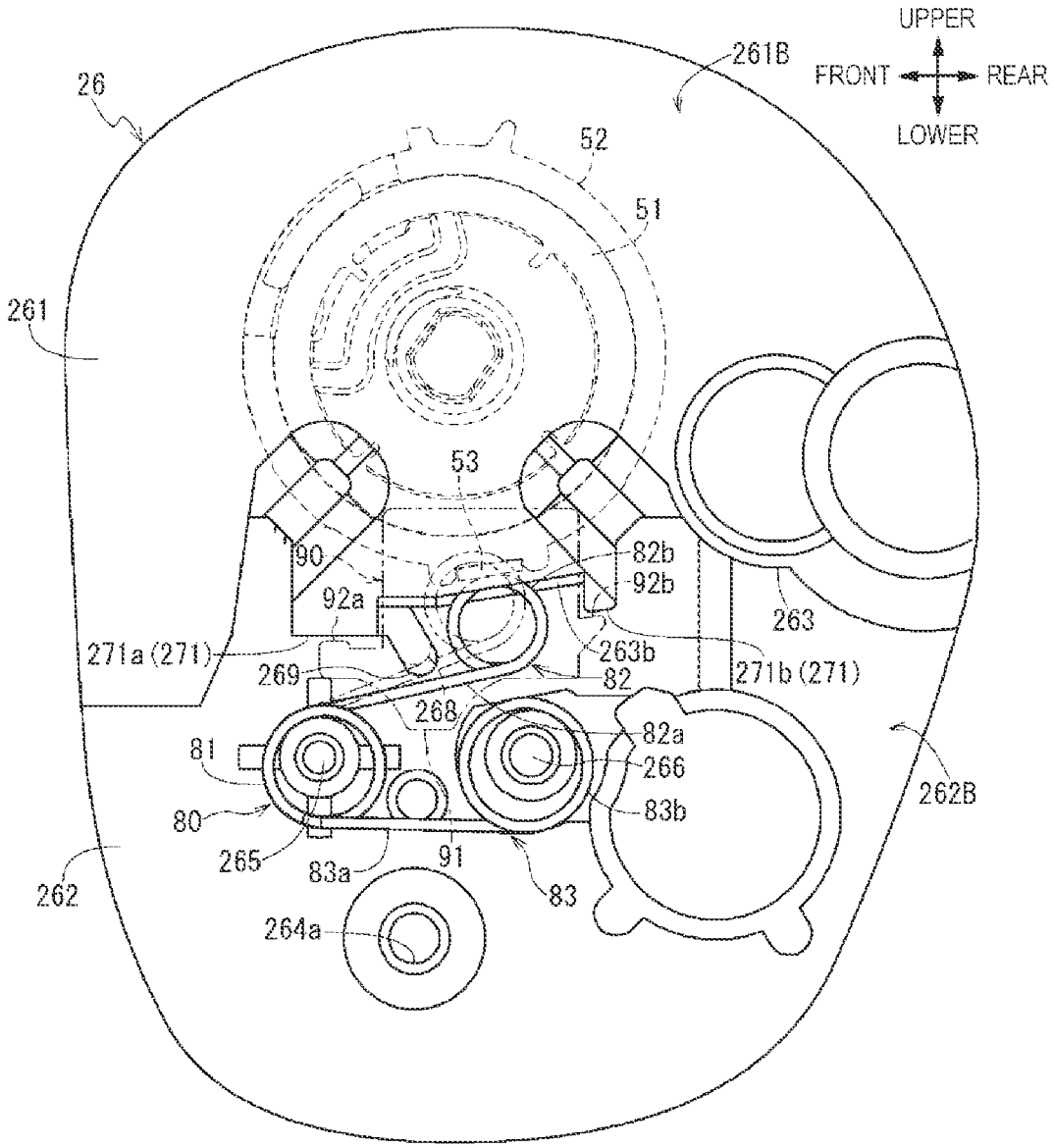
FIG. 8 is a side sectional view of the contact state between the electrode and the spring as viewed from the outer side surface side of the support frame.
Figure 9:
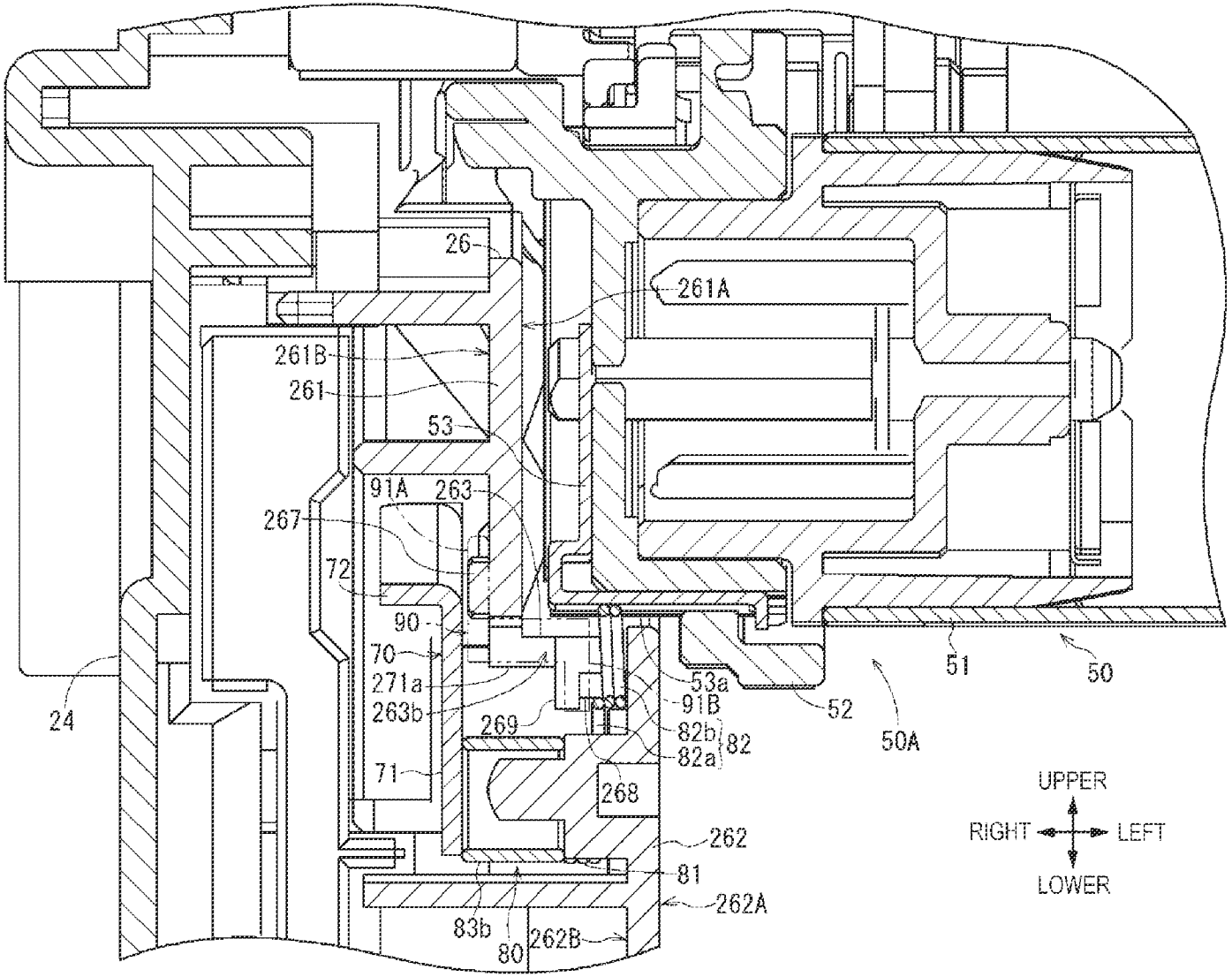
FIG. 9 is a rear sectional view showing the support frame in a state in which a bearing portion of the photoconductive drum is supported.
Figure 10:
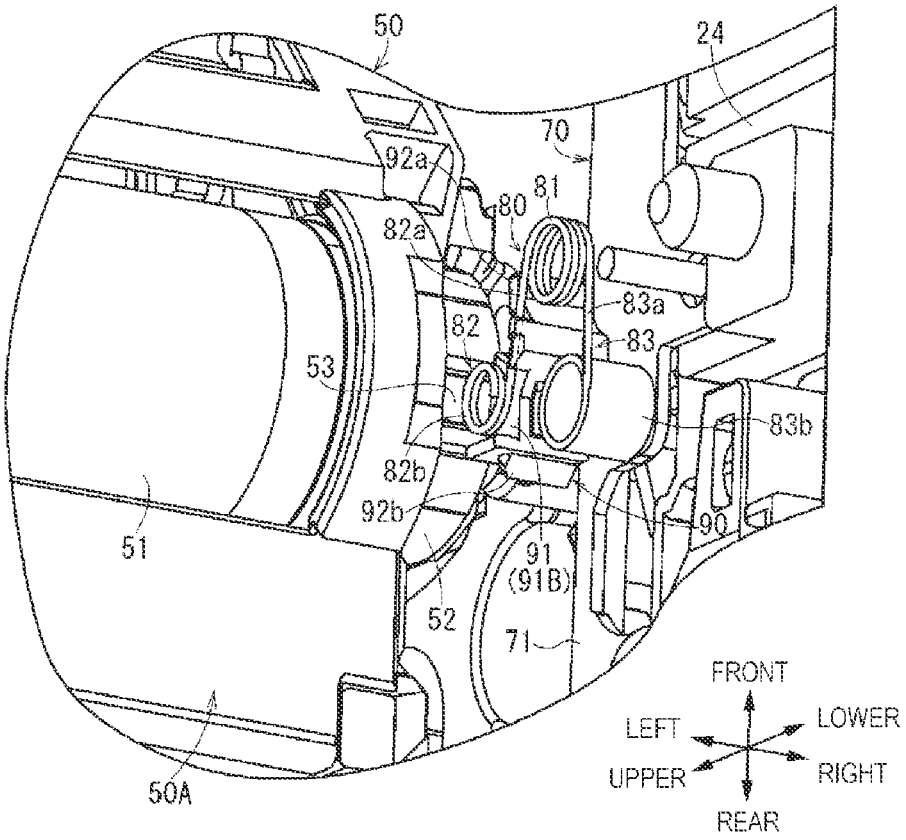
FIG. 10 is a perspective view showing the contact state between the electrode and the spring.

As shown in FIGS. 5 to 10, the apparatus main body 2 includes a ground metal plate 70, springs 80, and regulating members 90. The ground metal plate 70, the springs 80, and the regulating members 90 are disposed between the support frame 26 and the first main body frame 24 in the axis X direction. The ground metal plate 70, the springs 80, and the regulating members 90 are supported by the support frame 26. In FIG. 10, a description of the support frame 26 is omitted.

Ground Metal Plate

Figure 11A:
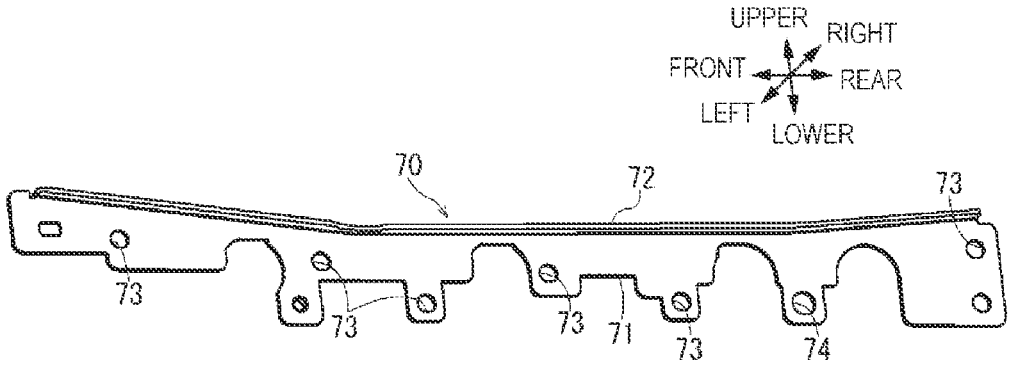
FIG. 11A is a perspective view showing a ground metal plate.
Figure 11B:
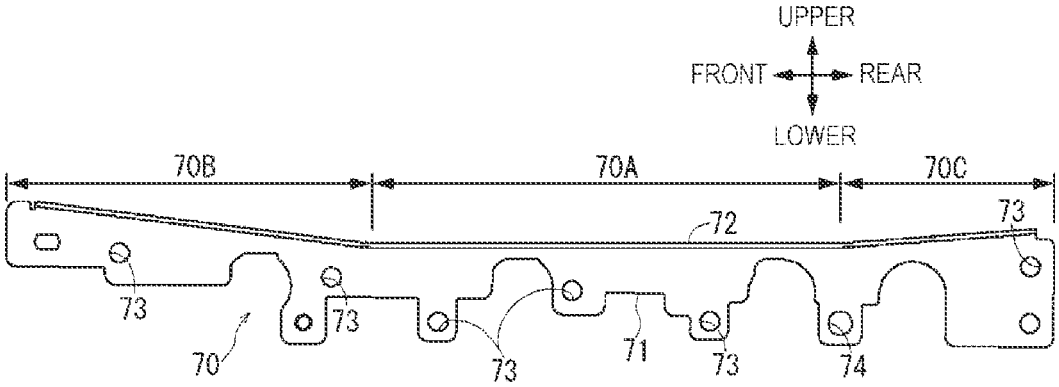
FIG. 11B is a side view showing the ground metal plate.
Figure 11C:
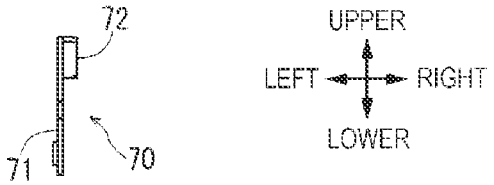
FIG. 11C is a front view showing the ground metal plate.

As shown in FIGS. 11A to 11C, the ground metal plate 70 is formed of a metal plate member and is connected to ground. The ground metal plate 70 includes a main body portion 71 extending in the front-rear direction and having a plate surface facing in the left-right direction, and a bent portion 72 that is bent in the left-right direction from an upper end of the main body portion 71. In the present embodiment, the bent portion 72 is bent rightward from the upper end of the main body portion 71. The front-rear direction is an example of a horizontal direction orthogonal to the axis direction of the photoconductive drum.

A plurality of fixing holes 73 are formed in the main body portion 71, and the ground metal plate 70 is attached to the support frame 26 by screwing screws inserted into the fixing holes 73 into screw holes 264*a* (see FIG. 6) formed on the outer side surface 262B side of the second wall portion 262 of the support frame 26.

The main body portion 71 of the ground metal plate 70 includes a middle portion 70A, a front portion 70B continuous with the front of the middle portion 70A, and a rear portion 70C continuous with the rear of the middle portion 70A. The middle portion 70A is an example of a first portion, and the front portion 70B and the rear portion 70C are each an example of a second portion. An upper end of the middle portion 70A is formed parallel to the horizontal direction. An upper end of the front portion 70B is inclined upwardly from the middle portion 70A as the upper end of the front portion 70B goes away forwards from the middle portion 70A in the horizontal direction. An upper end of the rear portion 70C is inclined upwardly from the middle portion 70A as the upper end of the rear portion 70C goes away rearwards from the middle portion 70A in the horizontal direction.

Since the ground metal plate 70 has the bent portion 72 that is bent from the upper end of the main body portion 71, rigidity is increased. In addition, by attaching the ground metal plate 70 having increased rigidity to the support frame 26, the rigidity of the support frame 26 can be improved, and a creep phenomenon that occurs in the support frame 26 can be prevented.

Since the main body portion 71 of the ground metal plate 70 includes the middle portion 70A whose upper end is formed parallel to the horizontal direction and the front portion 70B and the rear portion 70C whose upper ends are inclined in the direction in which the upper end rises as the front portion 70B and the rear portion 70C moves away from the middle portion 70A, the main body portion 71 is formed according to an arrangement position of a component in the support frame 26, and interference between the ground metal plate 70 and the component of the support frame 26 can be easily avoided.

Spring

Figure 12A:
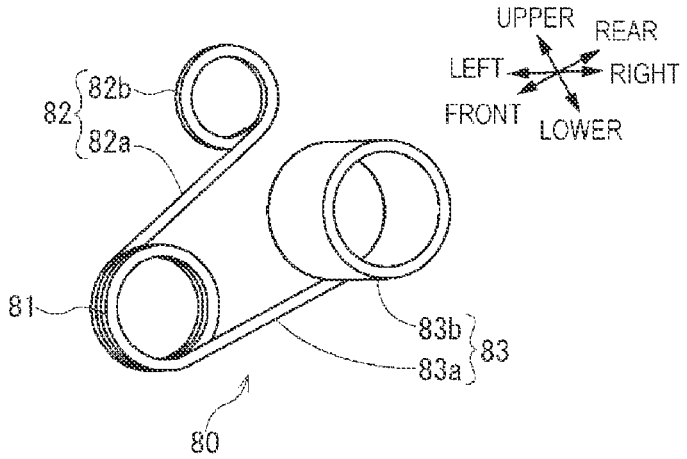
FIG. 12A is a perspective view showing the spring.
Figure 12B:
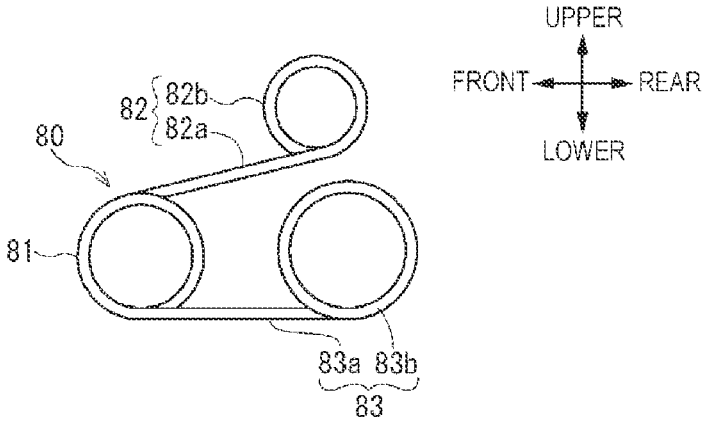
FIG. 12B is a side view showing the spring.
Figure 12C:
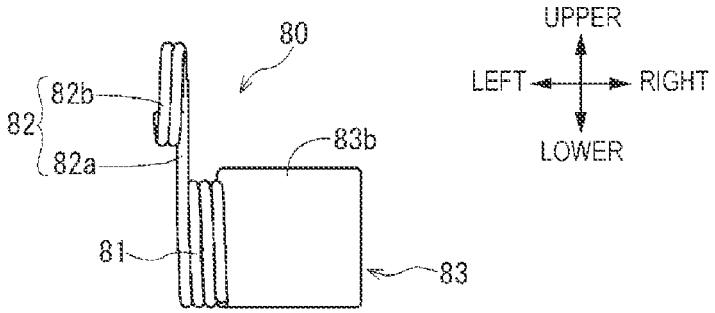
FIG. 12C is a front view showing the spring.
Figure 13:
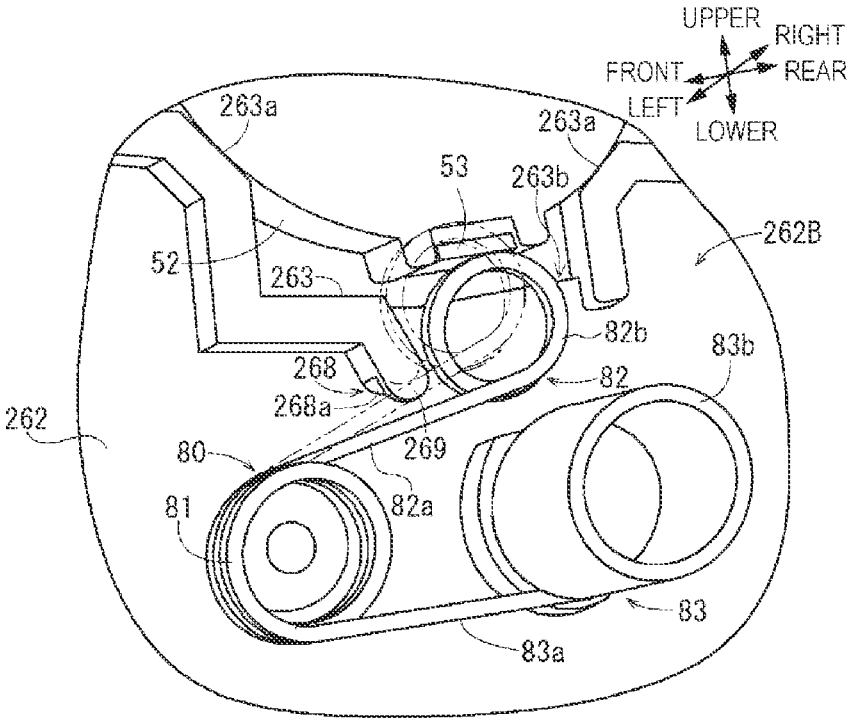
FIG. 13 is a perspective view showing a spring stopper and a locking portion of the support frame.
Figure 14A:
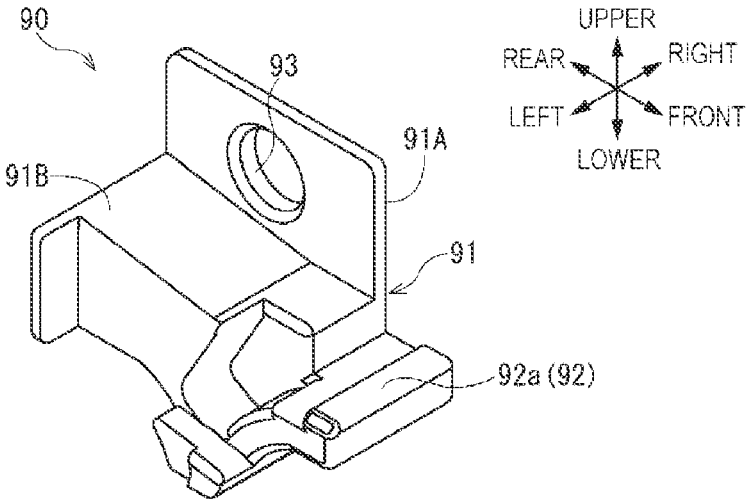
FIG. 14A is a perspective view showing a regulating member.
Figure 14B:
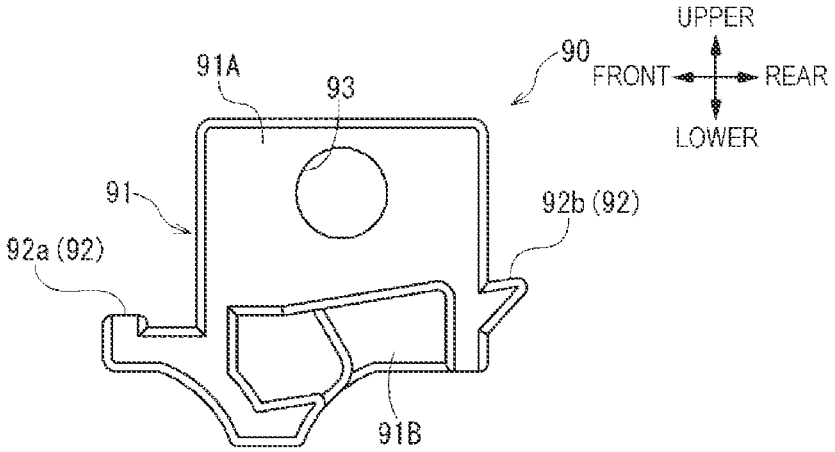
FIG. 14B is a side view showing the regulating member.

As shown in FIGS. 12A to 12C, a spring 80 is a coil spring formed by winding a wire rod, and includes a support portion 81, a first contact portion 82, and a second contact portion 83. The support portion 81 has an annular shape formed by winding a wire rod a plurality of times.

The second wall portion 262 of the support frame 26 includes an engagement protrusion 265 (see FIGS. 6 and 8) that protrudes from the outer side surface 262B in the axis X direction. The spring 80 is supported by the support frame 26 by engaging the support portion 81 with the engagement protrusion 265. The spring 80 is supported by the support frame 26 in a posture in which an axis direction of the support portion 81 and the axis X direction are parallel to each other. The spring 80 is disposed between the support frame 26 and the ground metal plate 70 in the axis X direction.

The first contact portion 82 includes an extending portion 82*a* that extends from the support portion 81 in a direction orthogonal to the axis X direction, and a contact portion 82*b* continuous with a distal end of the extending portion 82*a* and having an annular shape formed by winding a wire rod a plurality of times. The extending portion 82*a* extends substantially rearward, and the first contact portion 82 applies an urging force in a substantially upper-lower direction orthogonal to the axis X direction.

The second contact portion 83 includes an extending portion 83*a* that extends from the support portion 81 in a direction orthogonal to the axis X direction, and a contact portion 83*b* continuous with a distal end of the extending portion 83*a* and having a cylindrical shape formed by winding a wire rod a plurality of times. The extending portion 83*a* extends substantially rearward. The contact portion 83*b* has a larger number of windings of the wire rod than the support portion 81 and the contact portion 82*b*, and has a length in the axis X direction larger than that of the support portion 81 and the contact portion 82*b*. An axis direction of the contact portion 83*b* having the cylindrical shape is parallel to the axis X direction.

The second wall portion 262 of the support frame 26 includes an engagement protrusion 266 (see FIGS. 6 and 8) that protrudes from the outer side surface 262B in the axis X direction. The contact portion 83*b* is engaged with the engagement protrusion 266. By engaging the contact portion 83*b* with the engagement protrusion 266, the spring 80 is prevented from rotating around the support portion 81.

As shown in FIGS. 7 to 10 and 13, in the spring 80 supported by the support frame 26, the contact portion 82*b* of the first contact portion 82 protrudes upward from below the step portion 263 through the through hole 263*b* of the support frame 26. The contact portion 82*b* is contactable with the electrode 53 from below in a radial direction of the bearing portion 52 supported by the positioning portion 263*a*.

The first contact portion 82 applies an urging force directed substantially upward, and when the bearing portion 52 is not supported by the positioning portion 263*a* and the first contact portion 82 is not in contact with the electrode 53, the first contact portion 82 abuts against a spring stopper 268 of the support frame 26 to regulate a further upward movement. The spring stopper 268 is a protruding member that protrudes rightward from the outer side surface 262B of the second wall portion 262 of the support frame 26, and the extending portion 82*a* of the first contact portion 82 abuts against the spring stopper 268 from below. The spring stopper 268 has a lower surface 268*a* against which the first contact portion 82 abuts. The lower surface 268*a* of the spring stopper 268 has a circular arc shape that is convex downward as viewed from the axis X direction.

On the other hand, when the bearing portion 52 is supported by the positioning portion 263*a*, the first contact portion 82 of the spring 80 is pressed downward by the bearing portion 52, moves downward against the urging force of the first contact portion 82, and is away from the spring stopper 268. In addition, in a state in which the bearing portion 52 is supported by the positioning portion 263*a*, the contact portion 82*b* of the first contact portion 82 is in contact with the contact surface 53*a* of the electrode 53 located at the lower end of the bearing portion 52.

That is, the first contact portion 82 of the spring 80 is movable between a retracted position (a position indicated by a two-dot chain line in FIGS. 8 and 13) at which the first contact portion 82 is not in contact with the electrode 53 and is moved upward by the urging force of the spring 80, and a contact position (a position indicated by a solid line in FIGS. 8 and 13) at which the first contact portion 82 is pressed downward by the bearing portion 52 and is in contact with the electrode 53 in a state of being moved downward from the retracted position against the urging force of the spring 80. In addition, when the first contact portion 82 is at the retracted position, the first contact portion 82 abuts against the spring stopper 268, and when the first contact portion 82 is at the contact position, the first contact portion 82 is away from the spring stopper 268.

In this way, since the first contact portion 82 of the spring 80 abuts against the spring stopper 268 when at the retracted position and is regulated from moving upward, the first contact portion 82 of the spring 80 is prevented from excessively moving upward by the urging force of the spring 80, and the first contact portion 82 can smoothly move from the retracted position to the contact position when the first contact portion 82 is pressed downward by the bearing portion 52.

Since the lower surface 268*a* of the spring stopper 268 has the circular arc shape that is convex downward, the lower surface 268*a* of the spring stopper 268 and the first contact portion 82 of the spring 80 are in point contact with each other, so that it is possible to improve accuracy of a position where the movement is regulated when the first contact portion 82 repeatedly abuts against the lower surface 268*a* of the spring stopper 268.

The support frame 26 includes a locking portion 269 that extends downward from a right end serving as a distal end of the spring stopper 268 in a protruding direction. The locking portion 269 is capable of locking the extending portion 82*a* when the extending portion 82*a* of the first contact portion 82, which is at the retracted position and abuts against the spring stopper 268, is moved rightward.

As described above, by locking the first contact portion 82 that abuts against the spring stopper 268 by the locking portion 269, it is possible to regulate a movement of the spring 80 attached to the support frame 26 in the axis X direction, and it is possible to prevent the spring 80 from falling off from the support frame 26.

The locking portion 269 is formed of a flat plate-shaped member having a plate surface facing the axis X direction. The locking portion 269 is formed in a circular arc shape whose lower end is convex downward. As described above, by forming the locking portion 269 with the flat plate-shaped member, it is possible to reduce a space occupied by the locking portion 269 in the axis X direction.

The contact portion 83*b* of the second contact portion 83 protrudes rightward beyond the support portion 81 in the axis X direction, and a right end of the contact portion 83*b* is in contact with the ground metal plate 70 in the axis X direction. When the first contact portion 82 is in contact with the electrode 53 and the second contact portion 83 is in contact with the ground metal plate 70, the photoconductive drum 51 and the ground metal plate 70 are connected by the spring 80.

In this case, since the plate surface of the contact portion 83*b* of the second contact portion 83 is in contact with the ground metal plate 70 facing the axis X direction in the axis X direction, the contact portion 83*b* and the ground metal plate 70 can be in stably contact with each other.

The spring 80 is configured such that the photoconductive drum 51 and the ground metal plate 70 are connected by bring the contact portion 82*b* of the first contact portion 82 into contact with the contact surface 53*a* of the electrode 53 from below. Therefore, it is possible to reduce a space in the axis X direction for connecting the photoconductive drum 51 and the ground metal plate 70 that is a ground member on the apparatus main body 2 side, and it is possible to reduce the size of the apparatus main body 2.

As described above, since the spring 80 includes the first contact portion 82 contactable with the electrode 53 from below and the second contact portion 83 being in contact with the ground metal plate 70 in the axis X direction, it is possible to stably connect the photoconductive drum 51 and the ground metal plate 70 while reducing the space for connecting the photoconductive drum 51 and the ground metal plate 70.

Since the electrode 53 is located at the lower end of the bearing portion 52, it is possible to further reduce the space for connecting the electrode 53 and the ground metal plate 70 in the axis X direction.

Since the spring 80 applies the urging force in the substantially upper-lower direction orthogonal to the axis X direction, it is possible to further reduce the space for connecting the electrode 53 and the ground metal plate 70 in the axis X direction.

In the present embodiment, the coil spring is used as the spring 80, but the present disclosure is not limited thereto, and another type of spring such as a plate spring may be used as long as the spring is contactable with the contact surface 53*a* of the electrode 53 from below.

Regulating Member

As shown in FIGS. 7 to 10, 14A, 14B, and 15, the regulating member 90 includes a main body portion 91 and an abutting portion 92. The main body portion 91 includes a support portion 91A and a regulating portion 91B, and the support portion 91A has a support hole 93 penetrating in the left-right direction.

The first wall portion 261 of the support frame 26 includes a boss 267 (see FIGS. 6, 9, and 15) that protrudes from the outer side surface 261B in the axis X direction, and the support hole 93 of the support portion 91A of the regulating member 90 is fitted into the boss 267. When the support hole 93 is fitted into the boss 267, the regulating member 90 is supported by the support frame 26. The support portion 91A of the regulating member 90 faces the outer side surface 261B of the first wall portion 261 of the support frame 26.

The regulating portion 91B of the main body portion 91 is continuous with a lower portion of the support portion 91A. A length of the regulating portion 91B in the axis X direction is larger than that of the support portion 91A, and protrudes leftward of the support portion 91A.

The regulating portion 91B faces the outer side surface 262B of the second wall portion 262 of the support frame 26, and the first contact portion 82 of the spring 80 is located between the regulating portion 91B and the second wall portion 262 in the axis X direction. That is, the regulating portion 91B of the regulating member 90 is disposed between the first contact portion 82 of the spring 80 and the ground metal plate 70 in the axis X direction.

When the first contact portion 82 of the spring 80 moves to the right in the axis X direction, the regulating portion 91B abuts against the first contact portion 82, so that the movement of the spring 80 in the axis X direction can be regulated. In this way, by regulating the movement of the spring 80 in the axis X direction by the regulating member 90, it is possible to prevent the spring 80 supported by the support frame 26 from moving in the axis X direction and falling off from the support frame 26.

The regulating member 90 is located between the support frame 26 and the ground metal plate 70 in the axis X direction, and is regulated from moving in the axis X direction by the ground metal plate 70. As a result, the regulating member 90 supported by the support frame 26 can be prevented from moving in the axis X direction and falling off from the support frame 26.

Figure 15:
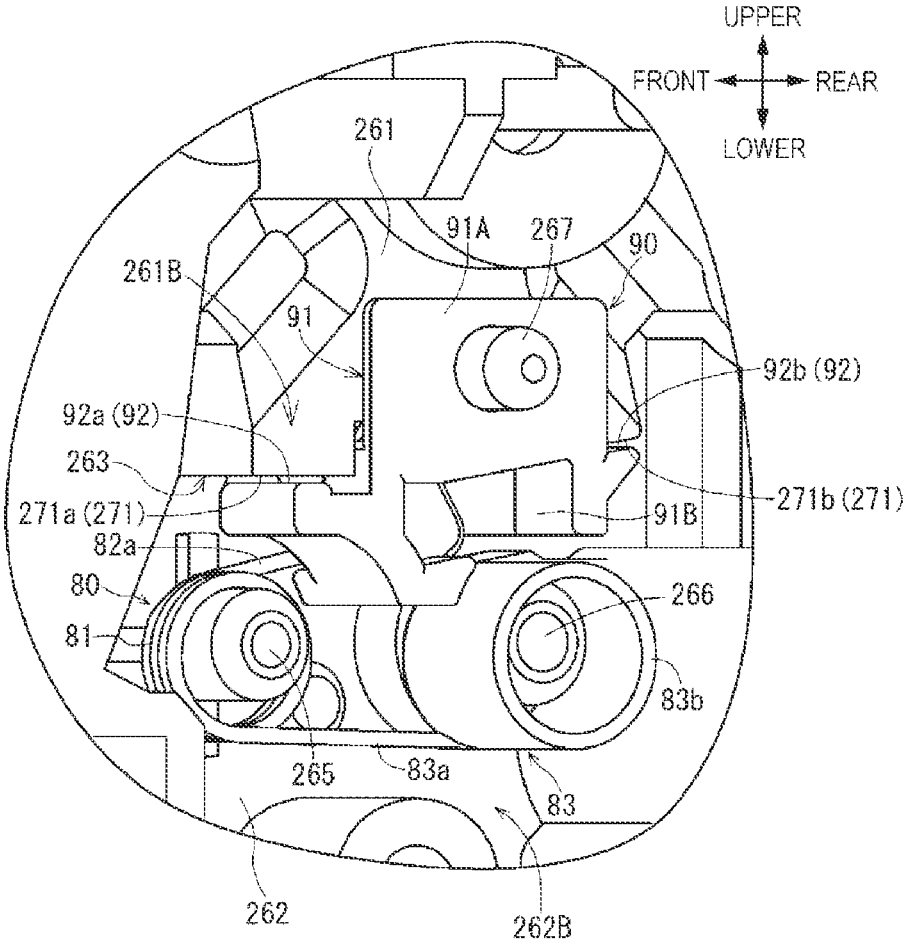
FIG. 15 is a perspective view showing the regulating member supported by the support frame.

As shown in FIGS. 8, 9, and 15, the step portion 263 of the support frame 26 includes a rotation stopper 271 that abuts against the regulating member 90 and regulate a rotation of the regulating member 90 around the boss 267. The rotation stopper 271 includes a first abutting surface 271*a* and a second abutting surface 271*b*.

The first abutting surface 271*a* is located in front of the boss 267, protrudes toward the regulating member 90 beyond the first contact portion 82 of the spring 80 in the axis X direction, and faces downward. The second abutting surface 271*b* is located rearward of the boss 267, protrudes toward the regulating member 90 beyond the first contact portion 82 of the spring 80 in the axis X direction, and faces downward. The front side is an example of one side in the horizontal direction orthogonal to the axis direction of the photoconductive drum. The rear side is an example of another side in the horizontal direction orthogonal to the axis direction of the photoconductive drum.

The abutting portion 92 of the regulating member 90 is supported by the main body portion 91, and is abuttable against the rotation stopper 271 of the support frame 26. The abutting portion 92 includes a first abutting piece 92*a* that protrudes forward from the regulating portion 91B of the main body portion 91 and abuts against the first abutting surface 271*a* from below, and a second abutting piece 92*b* that protrudes rearward from the regulating portion 91B of the main body portion 91 and abuts against the second abutting surface 271*b from below*.

The rotation of the regulating member 90 supported by the support frame 26 toward one side around the boss 267 is regulated when the first abutting surface 271*a* and the first abutting piece 92*a* abut against each other, and the rotation of the regulating member 90 toward another side around the boss 267 is regulated when the second abutting surface 271*b* and the second abutting piece 92*b* abut against each other By preventing the rotation of the regulating member 90 around the boss 267, the movement of the spring 80 in the axis X direction can be stably regulated by the regulating member 90. In particular, since the rotation of the regulating member 90 toward the one side and the rotation thereof toward the other side are prevented, the movement of the spring 80 in the axis X direction can be regulated more stably.

In the regulating member 90, the first abutting piece 92*a* protrudes forward from the regulating portion 91B, but the regulating member 90 may be configured such that the first abutting piece 92*a* protrudes forward from the support portion 91A. In addition, in the regulating member 90, the second abutting piece 92*b* protrudes rearward from the regulating portion 91B, but the regulating member 90 may be configured such that the second abutting piece 92*b* protrudes rearward from the support portion 91A.

Connection Between Ground Metal Plate and Metal Plate Cover

Figure 16:
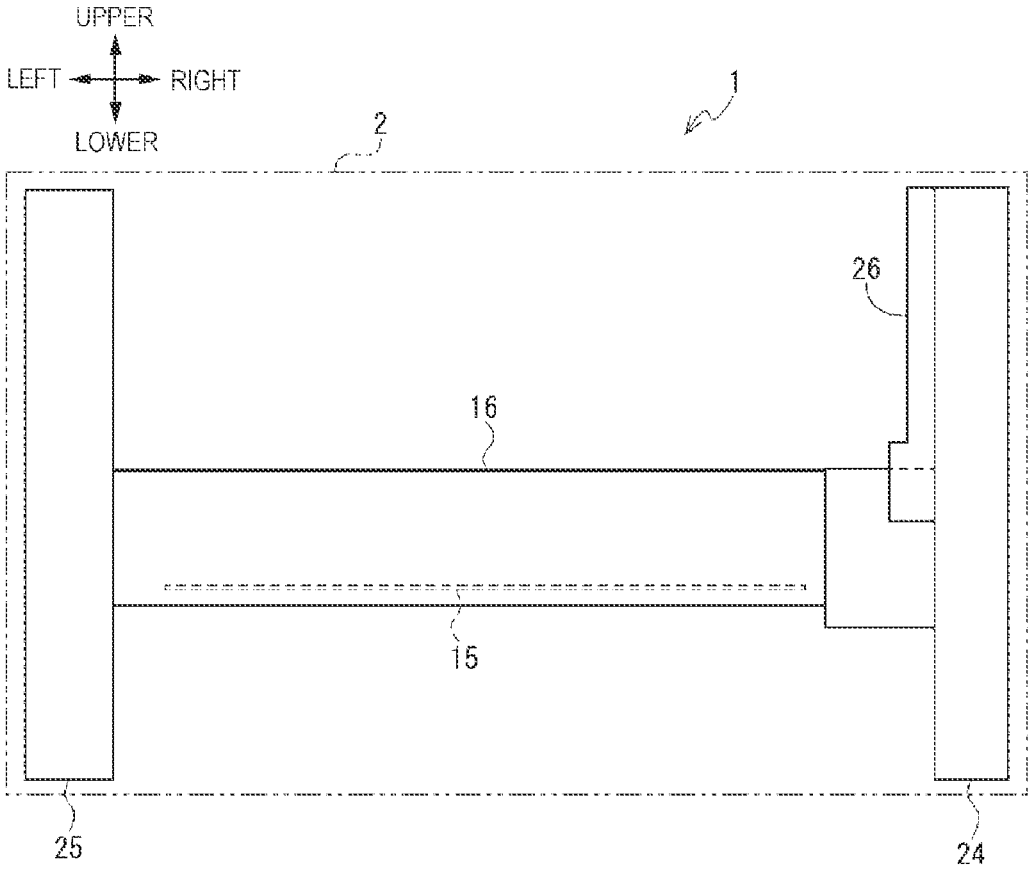
FIG. 16 is a front view showing a power supply board and a metal plate cover disposed between a first main body frame and a second main body frame.

As shown in FIG. 16, the apparatus main body 2 includes a power supply board 15 disposed between the first main body frame 24 and the second main body frame 25, and a metal plate cover 16 covering a periphery of the power supply board 15. The power supply board 15 is supported by the metal plate cover 16. A right end portion of the metal plate cover 16 is supported by the first main body frame 24, and a left end portion of the metal plate cover 16 is supported by the second main body frame 25. The metal plate cover 16 covers the front and rear and the upper and lower sides of the power supply board 15. The metal plate cover 16 is connected to ground.

Figure 17:
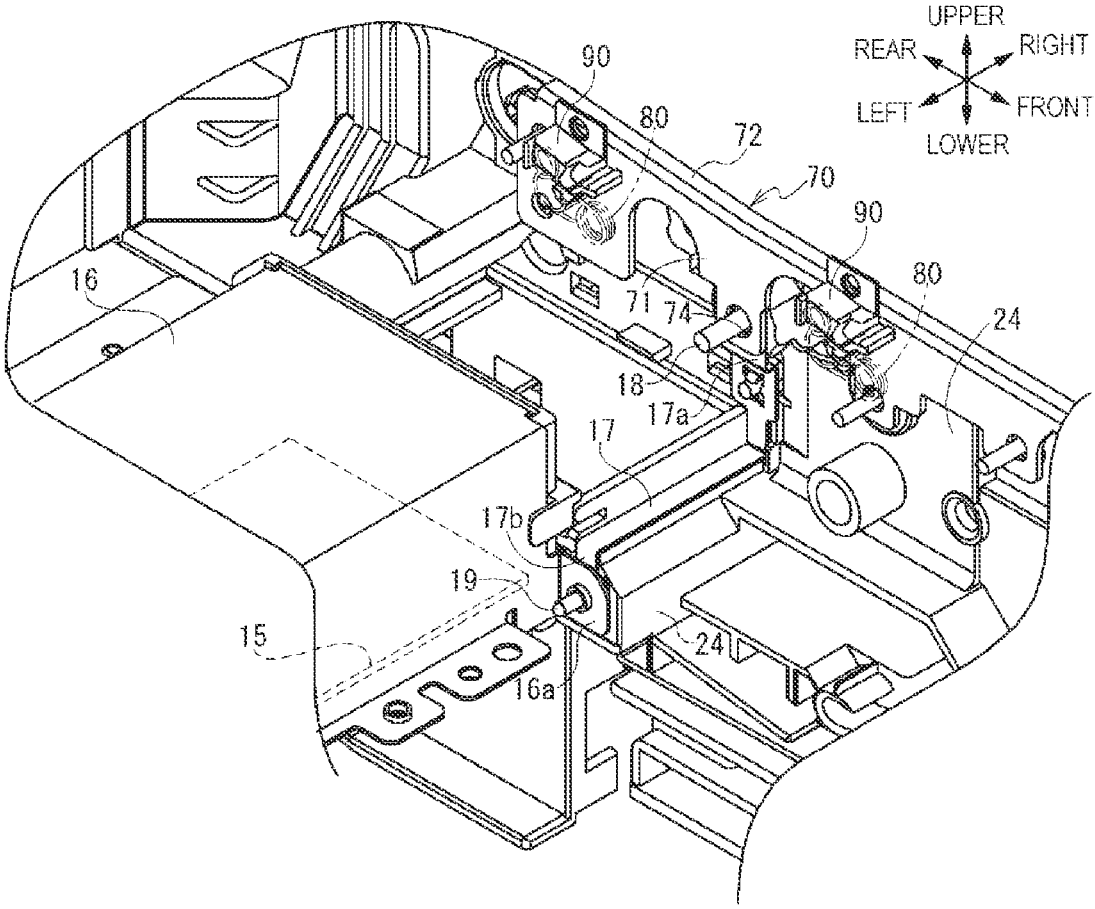
FIG. 17 is a perspective view showing a state in which the ground metal plate and the metal plate cover are connected by a metal plate member.
Figure 18:
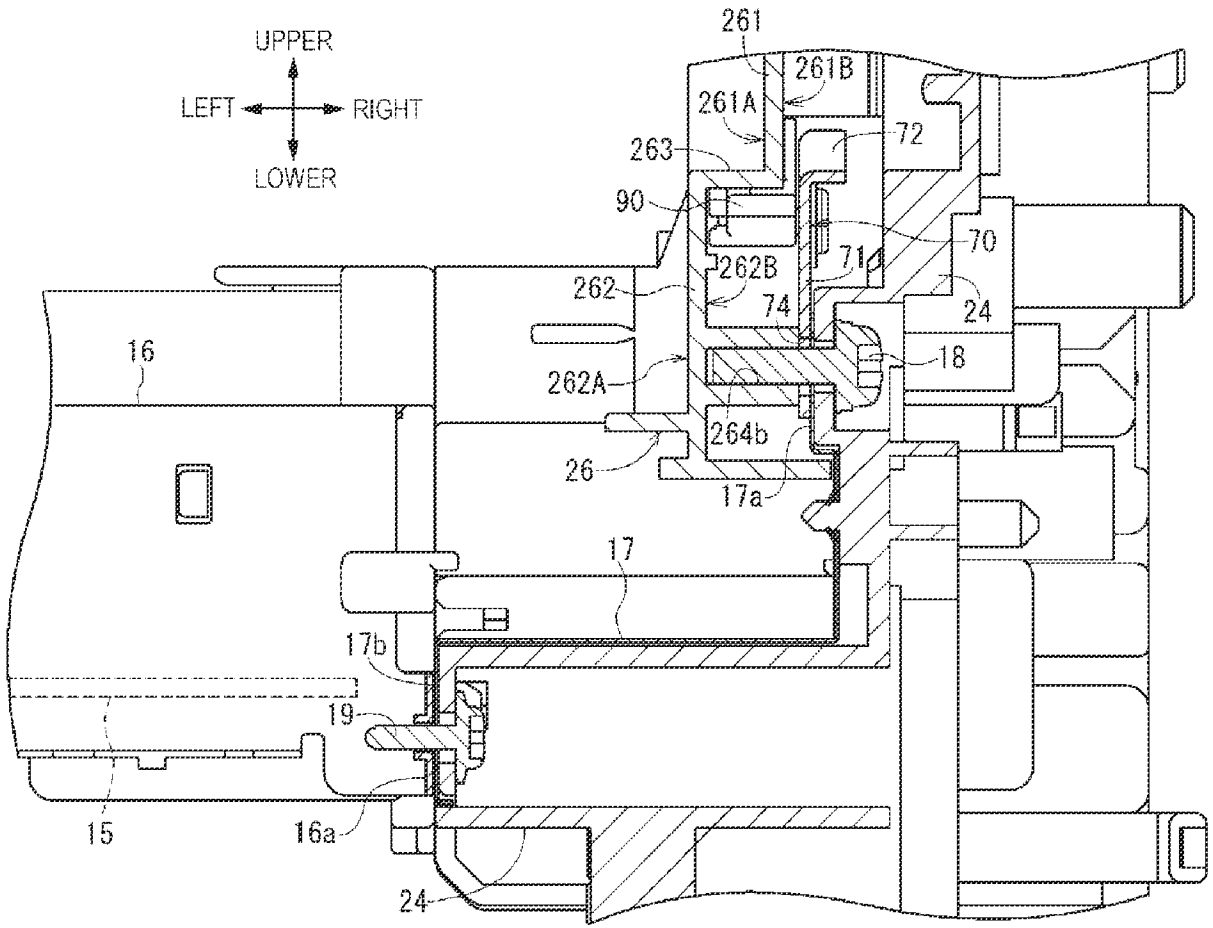
FIG. 18 is a front sectional view showing a state in which the ground metal plate and the metal plate cover are connected by the metal plate member.

As shown in FIGS. 17 and 18, the power supply board 15 is located on an opposite side to the ground metal plate 70 with respect to the support frame 26 in the axis X direction. The apparatus main body 2 includes a metal plate member 17 that connects the ground metal plate 70 and the metal plate cover 16. The metal plate member 17 includes a first end portion 17*a* close to the ground metal plate 70 and a second end portion 17*b* close to the metal plate cover 16. In FIG. 17, a description of the support frame 26 is omitted.

The first end portion 17*a* of the metal plate member 17 is located between the ground metal plate 70 and the first main body frame 24 in the axis X direction, and a screw hole 264*b* is formed on the outer side surface 262B of the second wall portion 262 of the support frame 26. The first end portion 17*a* of the metal plate member 17 is fastened to the support frame 26 together with the first main body frame 24 and the ground metal plate 70 by screwing a screw 18 into the screw hole 264*b*. In this case, the screw 18 penetrates through a through hole 74 formed in the ground metal plate 70. As a result, the first end portion 17*a* of the metal plate member 17 and the ground metal plate 70 are in contact with each other and connected to each other.

A protruding piece 16*a* protrudes forward from a right end portion of the metal plate cover 16, and the second end portion 17*b* of the metal plate member 17 is located between the protruding piece 16*a* and the first main body frame 24 in the axis X direction. The second end portion 17*b* of the metal plate member 17 is fastened to the protruding piece 16*a* together with the first main body frame 24 by screwing a screw 19 to the protruding piece 16*a*. As a result, the second end portion 17*b* of the metal plate member 17 and the protruding piece 16*a* are in contact with each other and connected to each other.

The first end portion 17*a* of the metal plate member 17 is connected to the ground metal plate 70, and the second end portion 17*b* of the metal plate member 17 is connected to the protruding piece 16*a*, so that the ground metal plate 70 and the metal plate cover 16 are connected by the metal plate member 17. Since the metal plate cover 16 is connected to ground, the ground metal plate 70 and the metal plate cover 16 are connected to each other, so that the ground metal plate 70 is also grounded. As a result, the ground metal plate 70 is connected and grounded via a simple connection path formed by the metal plate cover 16 and the metal plate member 17.

As described above, in the image forming apparatus 1, the photoconductive drum 51 is connected to ground by being sequentially connected to the electrode 53, the spring 80, the ground metal plate 70, the metal plate member 17, and the metal plate cover 16.

What is claimed is:

1. An image forming apparatus comprising:
- a process cartridge including:
  - a photoconductive drum; and
  - an electrode connected to the photoconductive drum and having a contact surface facing downward; and
- an apparatus main body to which the process cartridge is attachable and from which the process cartridge is detachable, the apparatus main body including:
  - a support frame supporting one end portion of the process cartridge in an axis direction of the photoconductive drum;
  - a ground metal plate supported by the support frame and connected to ground; and
  - a spring supported by the support frame and configured to contact with the contact surface of the electrode from below to connect the electrode and the ground metal plate,
- wherein the process cartridge includes a bearing portion supporting one end portion of the photoconductive drum in the axis direction, and
- wherein the electrode is located at a lower end of an outer peripheral surface of the bearing portion.

2. The image forming apparatus according to claim 1, wherein the spring is configured to apply an urging force in a direction orthogonal to the axis direction.

3. The image forming apparatus according to claim 1,
- wherein the spring is disposed between the support frame and the ground metal plate in the axis direction, and
- wherein the spring includes:
  - a first contact portion contactable with the electrode from below in a radial direction of the bearing portion, and
  - a second contact portion being in contact with the ground metal plate in the axis direction.

4. The image forming apparatus according to claim 3, wherein the apparatus main body includes a regulating member supported by the support frame, the regulating member being disposed between the spring and the ground metal plate in the axis direction and configured to regulate a movement of the spring in the axis direction.

5. The image forming apparatus according to claim 4,
- wherein the support frame includes:
  - a boss that protrudes in the axis direction and supports the regulating member, and
  - a rotation stopper abutting against the regulating member to regulate a rotation of the regulating member around the boss, and
- wherein the regulating member includes:
  - a main body portion supported by the boss, and
  - an abutting portion supported by the main body portion and abutting against the rotation stopper.

6. The image forming apparatus according to claim 5,
- wherein the rotation stopper of the support frame has:
  - a first abutting surface located on one side in a horizontal direction orthogonal to the axis direction with respect to the boss, the first abutting surface protruding toward the regulating member and beyond the spring in the axis direction, and facing downward, and a second abutting surface located on another side in the horizontal direction orthogonal to the axis direction with respect to the boss, the second abutting surface protruding toward the regulating member and beyond the spring in the axis direction, and facing downward, and wherein the abutting portion of the regulating member includes:

a first abutting piece that protrudes from the main body portion to the one side in the horizontal direction orthogonal to the axis direction and abuts against the first abutting surface from below, and a second abutting piece that protrudes from the main body portion toward the other side in the horizontal direction orthogonal to the axis direction and abuts against the second abutting surface from below.

7. The image forming apparatus according to claim 3, wherein the first contact portion of the spring is movable between a retracted position at which the first contact portion is not in contact with the electrode and is moved upward by an urging force of the spring, and a contact position at which the first contact portion is pressed downward by the bearing portion and is in contact with the electrode in a state of being moved downward from the retracted position against the urging force of the spring, wherein the support frame includes a spring stopper that protrudes in the axis direction, the spring stopper being configured to abut against the first contact portion to regulate an upward movement of the first contact portion, and wherein the first contact portion abuts against the spring stopper when the first contact portion is at the retracted position, and is away from the spring stopper when the first contact portion is at the contact position.

8. The image forming apparatus according to claim 7, wherein the spring stopper has a lower surface against which the first contact portion abuts, and wherein the lower surface has a circular arc shape that is convex downward as viewed from the axis direction.

9. The image forming apparatus according to claim 7, wherein the support frame includes a locking portion that extends downward from a distal end in a protruding direction of the spring stopper, the locking portion being capable of locking the first contact portion abutting against the spring stopper.

10. The image forming apparatus according to claim 9, wherein the locking portion is formed of a flat plate-shaped member having a plate surface facing the axis direction.

11. The image forming apparatus according to claim 1, wherein the spring is disposed below the contact surface.

12. An image forming apparatus comprising:

a process cartridge including:

a photoconductive drum; and an electrode connected to the photoconductive drum and having a contact surface facing downward; and an apparatus main body to which the process cartridge is attachable and from which the process cartridge is detachable, the apparatus main body including:

a support frame supporting one end portion of the process cartridge in an axis direction of the photoconductive drum;

a ground metal plate supported by the support frame and connected to ground; and a spring supported by the support frame and configured to contact with the contact surface of the electrode from below to connect the electrode and the ground metal plate, wherein the ground metal plate includes:

a main body portion that extends in a horizontal direction orthogonal to the axis direction and having a plate surface facing the axis direction, and a bent portion that is bent from an upper end of the main body portion in the axis direction.

13. The image forming apparatus according to claim 12, wherein the main body portion of the ground metal plate includes:

a first portion whose upper end is parallel to the horizontal direction, and a second portion continuous with the first portion in an extending direction of the main body portion and whose upper end is inclined upwardly from the first portion as the upper end of the second portion goes away from the first portion in the extending direction.

14. The image forming apparatus according to claim 12, wherein the spring is disposed below the contact surface.

15. An image forming apparatus comprising:

a process cartridge including:

a photoconductive drum; and an electrode connected to the photoconductive drum and having a contact surface facing downward; and an apparatus main body to which the process cartridge is attachable and from which the process cartridge is detachable, the apparatus main body including:

a support frame supporting one end portion of the process cartridge in an axis direction of the photoconductive drum;

a ground metal plate supported by the support frame and connected to ground; and a spring supported by the support frame and configured to contact with the contact surface of the electrode from below to connect the electrode and the ground metal plate, wherein the apparatus main body includes:

a power supply board located on an opposite side to the ground metal plate with respect to the support frame in the axis direction, a metal plate cover that covers the power supply board and is connected to ground, and a metal plate member that connects the metal plate cover and the ground metal plate.

16. The image forming apparatus according to claim 15, wherein the spring is disposed below the contact surface.

* * * * *